US011793364B1

(12) United States Patent
Fike et al.

(10) Patent No.: US 11,793,364 B1
(45) Date of Patent: Oct. 24, 2023

(54) BAR MOUNTING BATH SHELF DEVICE

(71) Applicants: Sara Fike, Clovis, CA (US); Justin Hoffman, Clovis, CA (US)

(72) Inventors: Sara Fike, Clovis, CA (US); Justin Hoffman, Clovis, CA (US)

( * ) Notice: Subject to any disclaimer, the term of this patent is extended or adjusted under 35 U.S.C. 154(b) by 0 days.

(21) Appl. No.: 17/863,878

(22) Filed: Jul. 13, 2022

(51) Int. Cl.
*A47K 3/28* (2006.01)
*A47K 1/09* (2006.01)
*A47B 96/02* (2006.01)

(52) U.S. Cl.
CPC ..... *A47K 3/281* (2013.01); *A47B 96/021* (2013.01); *A47K 1/09* (2013.01)

(58) Field of Classification Search
CPC . A47K 3/281; A47K 3/40; A47K 1/09; A47B 96/021
See application file for complete search history.

(56) References Cited

U.S. PATENT DOCUMENTS 1,730,345 A * 10/1929 Beman ..... A47J 47/16 211/74
2,912,114 A * 11/1959 Levitt ..... A47K 1/09 211/65
3,194,526 A * 7/1965 Lemmond ..... A47K 5/02 248/689
3,228,737 A * 1/1966 Kipnis ..... A47K 1/09 248/113
3,233,744 A * 2/1966 Ripps ..... A47K 1/09 108/26
3,239,850 A * 3/1966 Kiss ..... A47K 3/004 D6/406.4
3,409,144 A * 11/1968 Bridgman ..... A47K 5/02 211/75
3,789,996 A 2/1974 Stroh
3,794,181 A * 2/1974 Canham ..... A47K 1/09 248/205.3
4,008,808 A * 2/1977 Ramsay ..... A47K 1/09 312/207
4,233,911 A * 11/1980 Vignale ..... A47K 3/281 108/30
D260,830 S * 9/1981 Trouba ..... D6/552
D274,486 S * 7/1984 Thompson ..... D6/540
4,472,843 A * 9/1984 Chermak ..... A47K 3/004 D6/525

(Continued)

FOREIGN PATENT DOCUMENTS

CA 2492967 A1 * 1/2006 ..... A47K 1/09
EP 0261681 A2 * 3/1988

(Continued)

*Primary Examiner* — Stanton L Krycinski

(57) ABSTRACT

A bar mounting bath shelf device for attaching to a bar in a bath or shower for holding items on a horizontal surface includes a shelf with a clamp coupled to a bottom surface of the shelf, wherein the shelf is clampable to a cylindrical bar such that said shelf is positioned horizontally. The shelf has an aperture extending through a top surface of the shelf to the bottom surface which is configured for receiving a neck of a bottle while the shelf supports the bottle. The shelf also has a hole configured for receiving one of a toothbrush and a razor therethrough while the shelf supports the one of a toothbrush and a razor. And a slot extends from a front edge of the shelf to the hole, wherein the slot is configured for laterally receiving the one of a toothbrush and a razor into the hole.

19 Claims, 4 Drawing Sheets

(56) References Cited

U.S. PATENT DOCUMENTS 4,496,058 A * 1/1985 Harris ..... B62B 3/1428 206/557
4,890,746 A * 1/1990 Trulaske, Sr. ..... A47F 5/01 211/153
5,054,674 A * 10/1991 Fortman ..... B65H 49/20 225/6
D323,089 S * 1/1992 Koerbel ..... D6/525
D329,562 S * 9/1992 McKeone ..... D6/531
5,180,067 A * 1/1993 Conaway ..... A47K 3/281 211/16
5,181,621 A * 1/1993 Plaehn ..... A47K 5/04 211/119.011
D335,598 S * 5/1993 Kerbs ..... D6/525
5,255,401 A * 10/1993 Sambrookes ..... A47K 3/281 211/112
D359,186 S * 6/1995 Wang ..... D6/525
5,433,152 A * 7/1995 Henry ..... A47K 10/04 108/42
5,709,158 A * 1/1998 Wareheim ..... A47B 87/0246 211/188
D394,775 S * 6/1998 Anderson ..... D6/574
5,971,192 A * 10/1999 Immerman ..... A47K 5/02 220/DIG. 13
5,996,816 A * 12/1999 Bernard ..... A47K 1/09 211/65
6,089,383 A * 7/2000 Heneveld ..... B25H 3/06 206/315.9
6,115,857 A * 9/2000 Bidegain ..... A47K 3/281 4/574.1
6,253,931 B1 * 7/2001 Starkey ..... A47K 1/09 D6/531
6,401,943 B1 * 6/2002 Root ..... A47K 1/09 206/362.1
D475,229 S * 6/2003 Suero ..... A47K 3/281 D6/525
D475,560 S * 6/2003 Suero, Jr. ..... A47K 3/281 D6/525
6,588,030 B1 * 7/2003 Wulff ..... A47K 3/281 D6/532
D485,462 S * 1/2004 Suero, Jr. ..... A47K 3/281 D6/525
6,688,238 B1 * 2/2004 Alexiou ..... A47K 3/281 108/42
6,752,278 B2 * 6/2004 Craft ..... A47B 81/00 D6/552
D494,793 S * 8/2004 Winkleman ..... A47K 3/281 D6/525
D496,549 S * 9/2004 Snell ..... A47K 3/281 D6/525
7,188,629 B2 * 3/2007 Mehes ..... A47K 1/09 206/209.1
7,506,770 B2 * 3/2009 Rief ..... E04H 4/14 211/70.6
7,562,785 B2 * 7/2009 Meissen ..... B65D 81/36 220/4.28
D598,688 S 8/2009 Yang
7,931,160 B2 * 4/2011 Newbouild ..... A47K 3/281 211/90.02
D651,837 S * 1/2012 Yang ..... D6/525
D651,838 S 1/2012 Yang
8,261,920 B1 * 9/2012 Matthews ..... A47K 17/00 108/42
8,474,632 B2 7/2013 Yang
8,511,488 B2 * 8/2013 Poisson ..... A47B 96/021 211/183
8,596,473 B2 12/2013 Newbould
D705,586 S * 5/2014 Denby ..... D6/705.7
9,468,312 B2 * 10/2016 Denby ..... A47F 5/108
9,549,611 B1 * 1/2017 Bocanegra ..... A47B 81/00
9,629,506 B1 * 4/2017 Schwarz ..... A47K 1/09
9,926,954 B2 * 3/2018 Sortino ..... A47G 23/02
9,999,322 B2 * 6/2018 Hain ..... A47K 3/281
10,463,200 B2 11/2019 Patterson
11,357,365 B2 * 6/2022 Li ..... A47K 5/122
11,388,997 B1 * 7/2022 Ghiorghie ..... A47G 1/1653
11,607,083 B2 * 3/2023 Lavery ..... A47B 57/26
2001/0003332 A1 * 6/2001 Ventnor ..... A47K 1/09 211/70.6
2005/0056486 A1 * 3/2005 Butler ..... E06C 7/14 182/129
2006/0011209 A1 * 1/2006 Mehes ..... A47K 1/09 132/310
2006/0102569 A1 * 5/2006 Laga ..... A47F 5/0807 211/70.6
2012/0132602 A1 * 5/2012 Millspaugh ..... A47K 1/09 156/60
2014/0284293 A1 * 9/2014 Greco ..... A47K 3/281 211/85.12
2016/0058249 A1 * 3/2016 Pitman ..... A47K 1/09 248/311.2
2016/0095436 A1 * 4/2016 Baldwin ..... A47K 3/281 211/88.01
2016/0120313 A1 * 5/2016 Tang ..... A47B 47/0091 211/134
2016/0143438 A1 * 5/2016 Jablow ..... A47B 96/024 211/186
2016/0183682 A1 * 6/2016 Tang ..... A47B 96/021 211/134
2017/0049237 A1 * 2/2017 Nocik, Jr. ..... A47B 96/022
2021/0274982 A1 9/2021 Pasto
2022/0252247 A1 * 8/2022 Liu ..... A47K 3/004
2022/0313026 A1 * 10/2022 Mizrahi ..... A47K 3/281

FOREIGN PATENT DOCUMENTS

EP 2191757 12/2009
FR 1414260 A * 10/1965
GB 2498590 A * 7/2013 ..... A47G 29/00
WO WO-2013174742 A2 * 11/2013 ..... C04B 35/565

* cited by examiner

BAR MOUNTING BATH SHELF DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to bath shelves and more particularly pertains to a new bath shelf for attaching to a bar in a bath or shower for holding items on a horizontal surface.

(2) Description of Related Art Including Information Disclosed Under 37 CFR 1.97 and 1.98

The prior art relates to bath shelves which are inserted into a bath or shower for supporting bath items therein. The prior art discloses, among others, devices which mount to a horizontal or vertical rail for supporting the bath items. However, these devices designate particular cross-sectional shapes for the rails, as these devices are intended for installing a device-specific rail in order to use the device. One such rail-mounted device, for example, discloses a rail having a groove with caddies optionally attach to via associated rotating members which secure each caddy by engaging notches within the groove. Several devices also disclose attaching to and hanging from a shower head pipe. But the prior art does not disclose attaching a shelf to a cylindrical bar such that the shelf is disposed above the cylindrical bar in a horizontal position. Another feature included in the present invention not disclosed by the prior art is a hole positioned in a bath shelf for receiving the neck of a bottle while the shelf supports the bottle, thereby supporting the bottle upside down.

BRIEF SUMMARY OF THE INVENTION

An embodiment of the disclosure meets the needs presented above by generally comprising a shelf with a clamp coupled to a bottom surface of the shelf, wherein the shelf is clampable to a cylindrical bar such that said shelf is positioned horizontally. The shelf has an aperture extending through a top surface of the shelf to the bottom surface which is configured for receiving a neck of a bottle while the shelf supports the bottle. The shelf also has a hole configured for receiving one of a toothbrush and a razor therethrough while the shelf supports the one of a toothbrush and a razor. And a slot extends from a front edge of the shelf to the hole, wherein the slot is configured for laterally receiving the one of a toothbrush and a razor into the hole.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
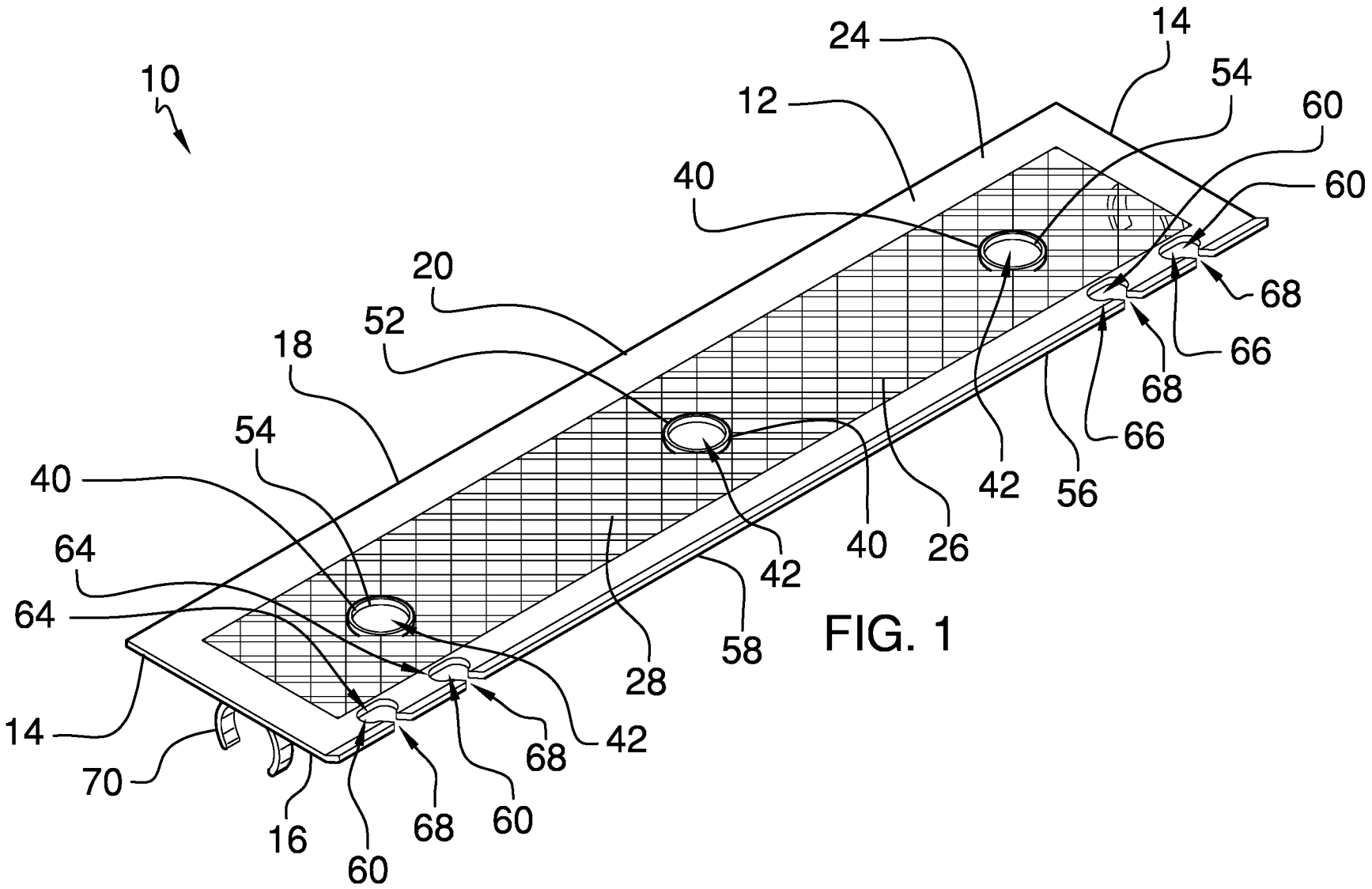
FIG. 1 is a top front side perspective view of a bar mounting bath shelf device according to an embodiment of the disclosure.
Figure 2:
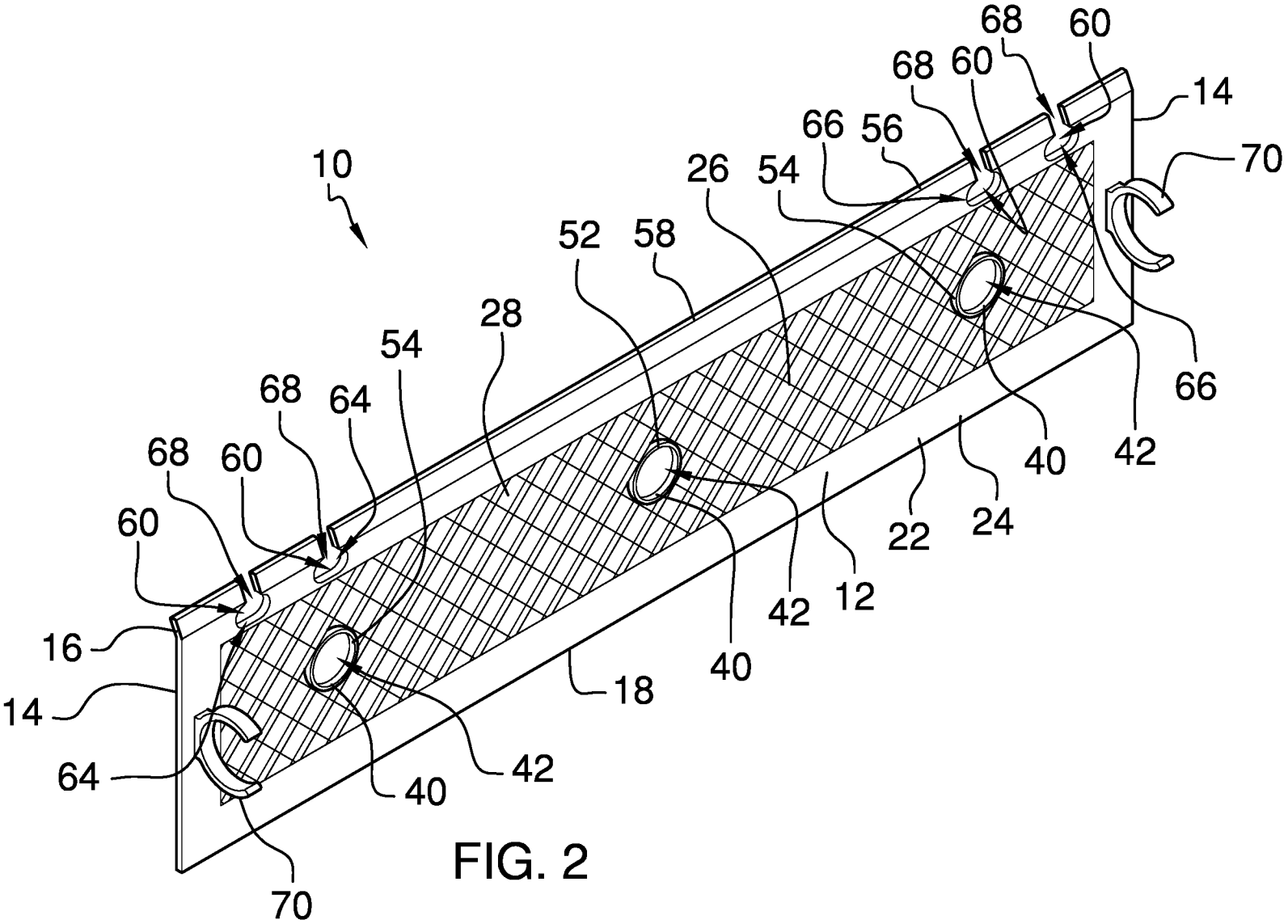
FIG. 2 is a bottom front side perspective view of an embodiment of the disclosure.
Figure 3:
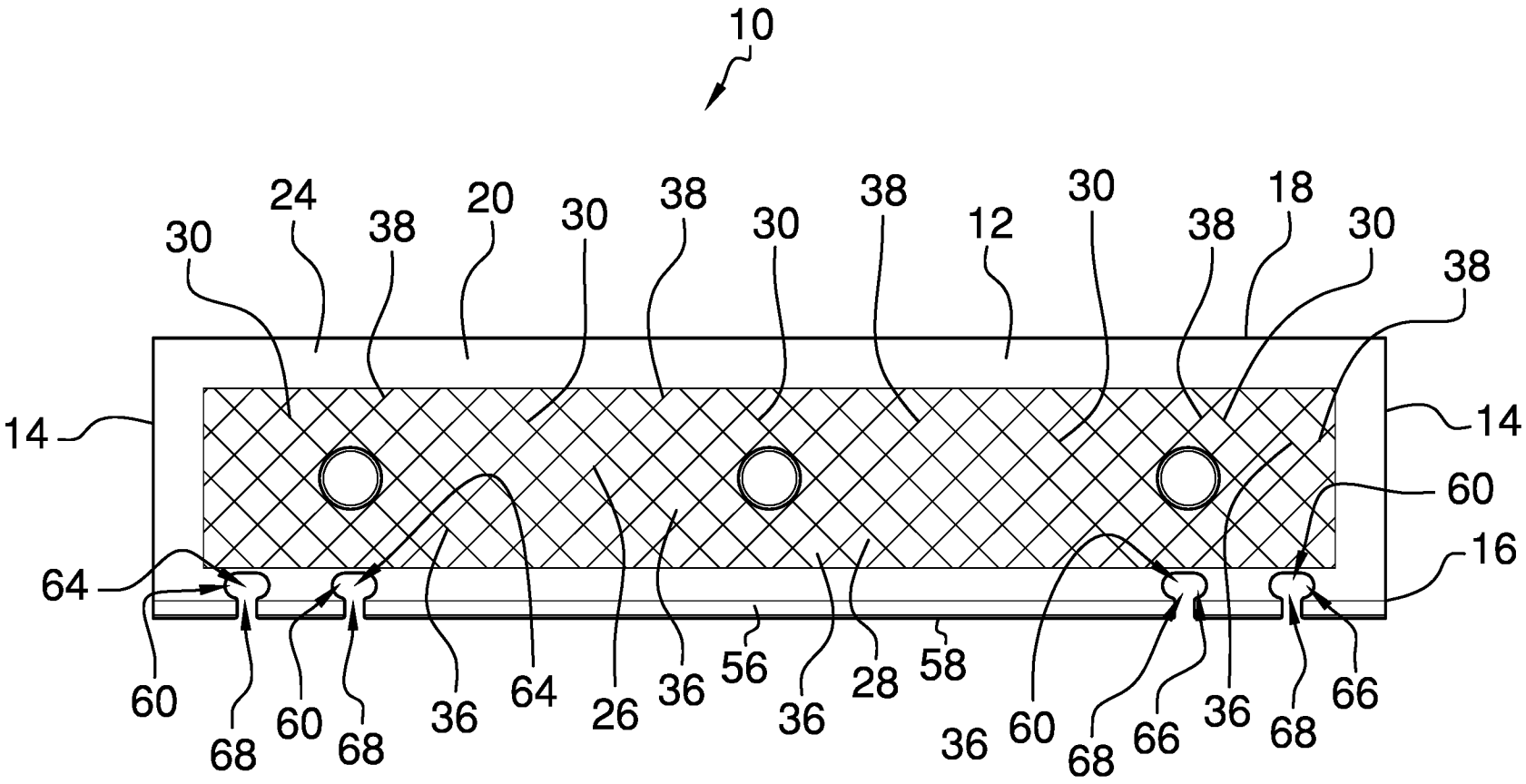
FIG. 3 is a top view of an embodiment of the disclosure.
Figure 4:
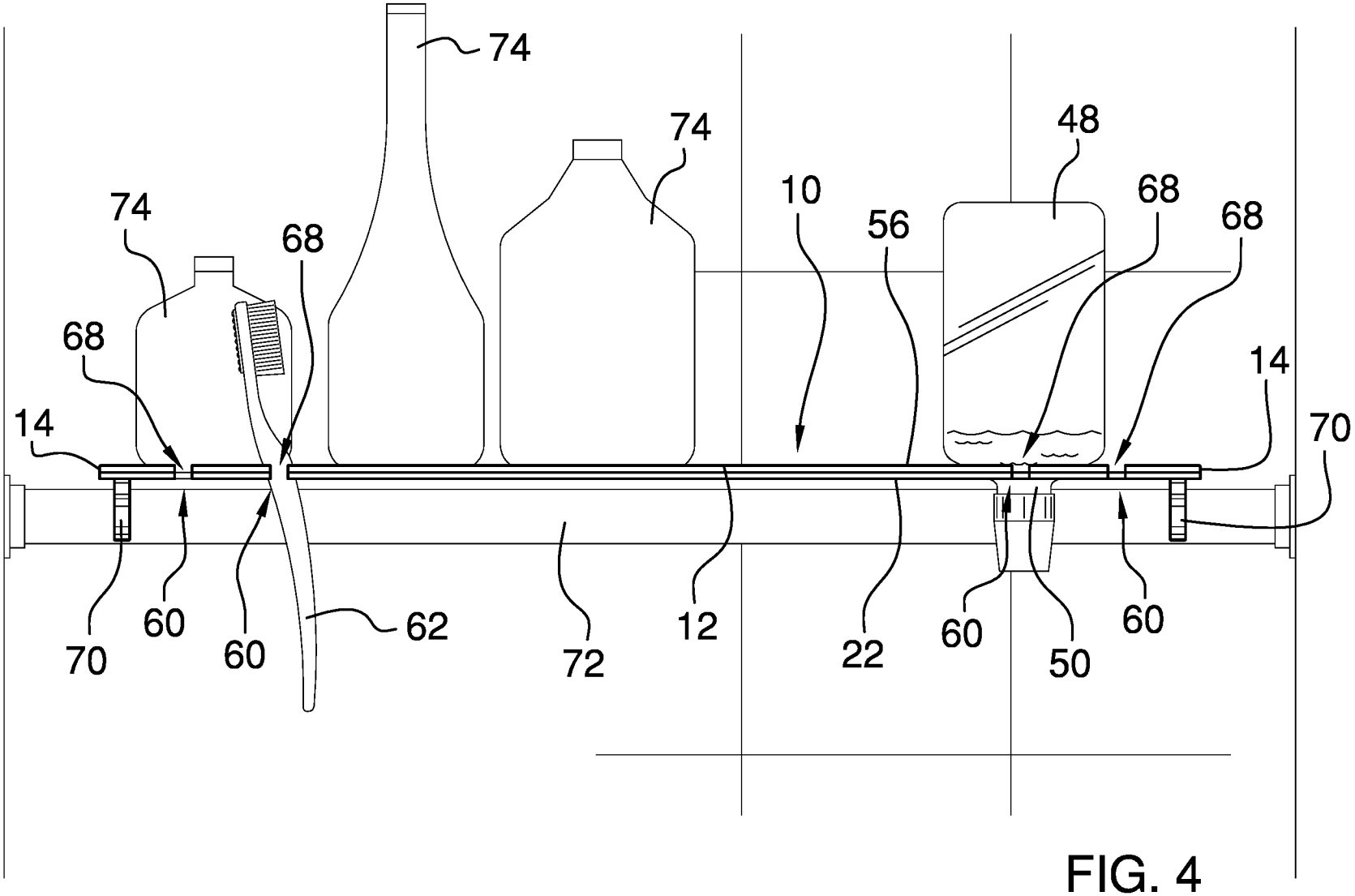
FIG. 4 is a front in-use view of an embodiment of the disclosure.

With reference now to the drawings, and in particular to FIGS. 1 through 4 thereof, a new bath shelf embodying the principles and concepts of an embodiment of the disclosure and generally designated by the reference numeral 10 will be described.

As best illustrated in FIGS. 1 through 4, the bar mounting bath shelf device 10 generally comprises a planar shelf 12. The shelf 12 has a pair of ends 14, a front edge 16, and a back edge 18 opposing the front edge 16, wherein each of the front edge 16 and the back edge 18 extend between the pair of ends 14. The shelf 12 also has a top surface 20 and a bottom surface 22 opposing the top surface 20 wherein each of the top surface 20 and the bottom surface 22 extending between the pair of ends 14 and between the front edge 16 and the back edge 18. The shelf 12 has a boundary portion 24 and a central portion 26 positioned within the boundary portion 24. The central portion 26 is formed of a grating 28 which is configured for draining a liquid. The grating 28 comprises a plurality of slats 30. Each slat 30 has a top side that is coplanar with the top surface 20 of the shelf 12 and a bottom side that is coplanar with the bottom surface 22 of the shelf 12. The plurality of slats 30 comprises a first portion 36 and a second portion 38. Each slat 30 of the first portion 36 is parallel to each other slat 30 of the first portion 36, and each slat 30 of the second portion 38 is parallel to each other slat 30 of the second portion 38. Each slat 30 of the first portion 36 is perpendicular to each slat 30 of the second portion 38, and each slat 30 of the plurality of slats 30 is positioned at a 45.0-degree angle to the back edge 18 of the shelf 12.

Each of a plurality of circular rings 40 is positioned within the central portion 26 of the shelf 12 and defines an associated aperture 42 of a plurality of apertures 42, wherein each aperture 42 extends 14 through the shelf 12. Each ring 40 has a top side that is coplanar with the top surface 20 of the shelf 12 and a bottom side is coplanar with the bottom surface 22 of the shelf 12. Each ring 40 is configured for receiving a neck 50 of a bottle 48 therethrough, and the shelf 12 is configured for supporting the bottle 48 on the top surface 20 while the neck 50 of the bottle 48 is received through an associated ring 40 of the plurality of rings 40. The plurality of rings 40 comprising a set of three equally sized and shaped rings 40 which are aligned parallel to the back edge 18 of the shelf 12. The set of three rings 40 comprise a center ring 52 and a pair of outer rings 54, wherein the center ring 52 is centered between the pair of ends 14 of the shelf 12 and the pair of outer rings 54 is equidistant from the center ring 52.

A lip 56 is coupled to and extends along the front edge 16 of the shelf 12. The lip 56 extends away from the shelf 12 and is angled upward when the top surface 20 of the shelf 12 faces upward. The lip 56 has a distal end 58 relative to the shelf 12. The central portion 26 of the shelf 12 is centered between the back edge 18 of the shelf 12 and the distal end 58 of the lip 56. Each ring 40 is also centered between the back edge 18 of the shelf 12 and the distal end 58 of the lip 56.

A plurality of equally sized and shaped holes 60 extends through the top surface 20 and the bottom surface 22. Each hole 60 is positioned in the boundary portion 24 of the shelf 12 between the front edge 16 of the shelf 12 and the central portion 26 of the shelf 12. Each hole 60 is configured for receiving one of a toothbrush 62 and a razor therethrough, and the shelf 12 is configured for supporting the one of a toothbrush 62 and a razor while being received through an associated hole 60 of the plurality of holes 60.

The plurality of holes 60 comprises a pair of first holes 64 and a pair of second holes 66. A distance between the pair of first holes 64 is equal to a distance between the pair of second holes 66. Each of the pair of first holes 64 and the pair of second holes 66 is positioned proximate an associated end 14 of the shelf 12, and the plurality of holes 60 is positioned symmetrically about a midpoint of the front edge 16 of the shelf 12. The plurality of holes 60 is also aligned parallel to the back edge 18 of the shelf 12, and each hole 60 is elongated parallel to the back edge 18 of the shelf 12.

Each of a plurality of equally sized and shaped slots 68 extend between the distal end 58 of the lip 56 and an associated hole 60 of the plurality of holes 60. Each slot 68 has a width parallel to the back edge 18 of the shelf 12 less than a width of the associated hole 60 parallel to the back edge 18 of the shelf 12. Each slot 68 is configured for laterally receiving the one of a toothbrush 62 and a razor therethrough.

Each of a pair of clamps 70 is constructed of a resilient, elastic material and is coupled to and extends away from the bottom surface 22 of the shelf 12. Each clamp 70 is coupled to the boundary portion 24 of the shelf 12 and is positioned proximate an associated end 14 of the shelf 12. The pair of clamps 70 is aligned parallel to the back edge 18 of the shelf 12 and centered between the back edge 18 of the shelf 12 and the distal end 58 of the lip 56. Each clamp 70 is arcuate and is configured for elastically clamping to a cylindrical bar 72 whereby the shelf 12 is coupled to the cylindrical bar 72 in a horizontal position. The shelf 12 is configured for supporting an item 74 on the top surface 20 when in the horizontal position. "Horizontal position" as used in the detailed description and the claims includes all positions where the item 74 is supportable on the top surface 20.

In use, the device 10 is elastically clamped to a cylindrical bar 72 such that the shelf 12 is coupled to the cylindrical bar 72 in a horizontal position. Then, an item 74 may be supported on the top surface 20 of the shelf 12, a bottle 48 may be inserted into a ring 40 of said plurality of rings 40 such that the shelf 12 supports the bottle 48, and one of the toothbrush 62 and the razor may be inserted laterally through a slot 68 of the plurality of slots 68 and into an associated hole 60 of said plurality of holes 60 whereby the shelf 12 supports the one of a toothbrush 62 and a razor as desired. Liquid which falls onto the shelf 12 will drain through the grating 28 of the central portion 26 of the shelf 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A bar mounting bath shelf device comprising:

a shelf, said shelf having a pair of ends, said shelf having a front edge and a back edge opposing said front edge, each of said front edge and said back edge extending between said pair of ends, said shelf having a top surface and a bottom surface opposing said top surface, each of said top surface and said bottom surface extending between said pair of ends and between said front edge and said back edge, said shelf being planar;

an aperture, said aperture extending through said top surface of said shelf and said bottom surface of said shelf, said aperture being configured for receiving a neck of a bottle therethrough, said shelf being configured for supporting the bottle on the top surface while the neck of the bottle is received through said aperture;

a hole, said hole extending through said top surface and said bottom surface, said hole being positioned proximate said front edge of said shelf, said hole being configured for receiving one of a toothbrush and a razor therethrough, said shelf being configured for supporting the one of a toothbrush and a razor while being received through said hole;

a slot, said slot extending between said front edge of said shelf and said hole, said slot having a width parallel to said back edge of said shelf less than a width of said hole parallel to said back edge of said shelf, each said slot being configured for laterally receiving the one of a toothbrush and a razor therethrough;

a clamp, said clamp being coupled to and extending away from said bottom surface of said shelf, said clamp being configured for clamping to a bar whereby said shelf is coupled to the bar in a horizontal position, said shelf being configured for supporting an item on said top surface when in said horizontal position; and said shelf having a boundary portion and a central portion being positioned within the boundary portion, said central portion being formed of a grating, said grating being configured for draining a liquid, said grating comprising a plurality of slats, each said slat having a top side being coplanar with said top surface of said shelf and a bottom side being coplanar with said bottom surface of said shelf.

2. The device of claim 1, further comprising said plurality of slats comprising a first portion and a second portion having a plurality of said slats, each slat of said first portion being parallel to each other slat of said first portion, each slat of said second portion being parallel to each other slat of said second portion, each said slat of said first portion being perpendicular to each said slat of said second portion, each said slat of said plurality of slats being positioned at a 45.0-degree angle to said back edge.

3. The device of claim 1, further comprising said aperture being defined by a ring positioned within said central portion of said shelf.

4. The device of claim 3, further comprising said ring having a top side being coplanar with said top surface of said shelf and a bottom side being coplanar with said bottom surface of said shelf.

5. The device of claim 1, further comprising said aperture being circular.

6. The device of claim 1, further comprising said aperture being one of a plurality of apertures, each said aperture extending through said top surface of said shelf and said bottom surface of said shelf, each said aperture being configured for receiving a neck of a bottle therethrough, said shelf being configured for supporting the bottle on the top surface while the neck of the bottle is received through each said aperture.

7. The device of claim 6, further comprising said plurality of apertures being aligned parallel to said back edge of said shelf.

8. The device of claim 6, further comprising each said aperture being equal in size and shape to each other aperture.

9. The device of claim 3, further comprising a lip, said lip being coupled to and extending along said front edge of said shelf, said lip extending away from said shelf, said lip being angled upward when said top surface of said shelf faces upward, said lip having a distal end relative to said shelf.

10. The device of claim 9, further comprising said central portion of said shelf being centered between said back edge of said shelf and said distal end of said lip.

11. The device of claim 9, further comprising said ring being centered between said back edge of said shelf and said distal end of said lip.

12. The device of claim 9, further comprising:

said hole being one of a plurality of holes, said plurality of holes extending through said top surface and said bottom surface, each said hole being positioned in said boundary portion of said shelf between said front edge of said shelf and said central portion of said shelf, each said hole being configured for receiving the one of a toothbrush and a razor therethrough, said shelf being configured for supporting the one of a toothbrush and a razor while being received through an associated hole of said plurality of holes; and said slot being one of a plurality of slots, each said slot extending between said distal end of said lip and an associated hole of said plurality of holes, each said slot having a width parallel to said back edge of said shelf less than a width of said associated hole parallel to said back edge of said shelf, each said slot being configured for laterally receiving the one of a toothbrush and a razor therethrough.

13. The device of claim 12, further comprising said plurality of holes comprising a pair of first holes and a pair of second holes, a distance between said pair of first holes being equal to a distance between said pair of second holes, each of said pair of first holes and said pair of second holes being positioned proximate an associated end of said shelf, said plurality of holes being positioned symmetrically about a midpoint of said front edge of said shelf.

14. The device of claim 12, further comprising said plurality of holes being aligned parallel to said back edge of said shelf, each said hole being elongated parallel to said back edge of said shelf.

15. The device of claim 12, further comprising each said hole being equal in size and shape to each other hole, each said slot being equal in size and shape to each other slot.

16. The device of claim 9, further comprising said clamp being one of a pair of clamps, each said clamp being coupled to and extending away from said bottom surface of said shelf, each said clamp being configured for clamping to the bar whereby said shelf is coupled to the bar in a horizontal position.

17. The device of claim 16, further comprising each of said clamps being positioned proximate an associated end of said shelf, said pair of clamps being aligned parallel to said back edge of said shelf and centered between said back edge of said shelf and said distal end of said lip.

18. The device of claim 1, further comprising said clamp being constructed of a resilient, elastic material, said clamp being arcuate, said clamp being configured for elastically clamping to a cylindrical bar.

19. A bar mounting bath shelf device comprising:

a shelf, said shelf having a pair of ends, said shelf having a front edge and a back edge opposing said front edge, each of said front edge and said back edge extending between said pair of ends, said shelf having a top surface and a bottom surface opposing said top surface, each of said top surface and said bottom surface extending between said pair of ends and between said front edge and said back edge, said shelf being planar, said shelf having a boundary portion and a central portion being positioned within the boundary portion, said central portion being formed of a grating, said grating being configured for draining a liquid, said grating comprising a plurality of slats, each said slat having a top side being coplanar with said top surface of said shelf and a bottom side being coplanar with said bottom surface of said shelf, said plurality of slats comprising a first portion and a second portion having a plurality of said slats, each slat of said first portion being parallel to each other slat of said first portion, each slat of said second portion being parallel to each other slat of said second portion, each said slat of said first portion being perpendicular to each said slat of said second portion, each said slat of said plurality of slats being positioned at a 45.0-degree angle to said back edge;

a plurality of rings, said plurality of rings being positioned within said central portion of said shelf, each said ring defining an associated aperture of a plurality of apertures, each said aperture extending through said shelf, each said ring having a top side being coplanar with said top surface of said shelf and a bottom side being coplanar with said bottom surface of said shelf, each said ring being circular, each said ring being configured for receiving a neck of a bottle therethrough, said shelf being configured for supporting the bottle on the top surface while the neck of the bottle is received through an associated ring of said plurality of rings, said plurality of rings comprising a set of three rings, said set of three rings comprising a center ring and a pair of outer rings, said center ring being centered between said pair of ends of said shelf, said pair of outer rings being equidistant from said center ring, said set of three rings being aligned parallel to said back edge of said shelf, each said ring being equal in size and shape to each other ring;

a lip, said lip being coupled to and extending along said front edge of said shelf, said lip extending away from said shelf, said lip being angled upward when said top surface of said shelf faces upward, said lip having a distal end relative to said shelf, said central portion of said shelf being centered between said back edge of said shelf and said distal end of said lip, said plurality of rings being aligned along a line, said line being centered between said back edge of said shelf and said distal end of said lip;

a plurality of holes, said plurality of holes extending through said top surface and said bottom surface, each said hole being positioned in said boundary portion of said shelf between said front edge of said shelf and said central portion of said shelf, each said hole being configured for receiving one of a toothbrush and a razor therethrough, said shelf being configured for supporting the one of a toothbrush and a razor while being received through an associated hole of said plurality of holes, said plurality of holes comprising a pair of first holes and a pair of second holes, a distance between said pair of first holes being equal to a distance between said pair of second holes, each of said pair of first holes and said pair of second holes being positioned proximate an associated end of said shelf, said plurality of holes being positioned symmetrically about a midpoint of said front edge of said shelf, said plurality of holes being aligned parallel to said back edge of said shelf, each said hole being elongated parallel to said back edge of said shelf, each said hole being equal in size and shape to each other hole;

a plurality of slots, each said slot extending between said distal end of said lip and an associated hole of said plurality of holes, each said slot having a width parallel to said back edge of said shelf less than a width of said associated hole parallel to said back edge of said shelf, each said slot being configured for laterally receiving the one of a toothbrush and a razor therethrough, each said slot being equal in size and shape to each other slot; and a pair of clamps, each said clamp being constructed of a resilient, elastic material, each said clamp being coupled to and extending away from said bottom surface of said shelf, each said clamp being coupled to said boundary portion of said shelf, each said clamp being positioned proximate an associated end of said shelf, said pair of clamps being aligned parallel to said back edge of said shelf and centered between said back edge of said shelf and said distal end of said lip, each said clamp being arcuate, each said clamp being configured for elastically clamping to a cylindrical bar whereby said shelf is coupled to the bar in a horizontal position, said shelf being configured for supporting an item on said top surface when in said horizontal position.

* * * * *